US009785072B2

(12) United States Patent
Kihira et al.

(10) Patent No.: US 9,785,072 B2
(45) Date of Patent: Oct. 10, 2017

(54) ELECTROPHOTOGRAPHIC TONER USING BIOPLASTIC AND PRODUCTION METHOD THEREOF

(71) Applicant: CASIO COMPUTER CO., LTD., Shibuya-ku, Tokyo (JP)

(72) Inventors: Kenji Kihira, Kiyose (JP); Hideki Ikeda, Hamura (JP); Yuichiro Iegaki, Kodaira (JP); Yuta Kan, Tokorozawa (JP); Hideki Hasegawa, Higashimurayama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 72 days.

(21) Appl. No.: 14/664,490

(22) Filed: Mar. 20, 2015

(65) Prior Publication Data

US 2015/0362851 A1 Dec. 17, 2015

(30) Foreign Application Priority Data

Jun. 11, 2014 (JP) ..... 2014-120407

(51) Int. Cl.
*G03G 9/087* (2006.01)
*G03G 9/08* (2006.01)

(52) U.S. Cl.
CPC ..... *G03G 9/08755* (2013.01); *G03G 9/081* (2013.01); *G03G 9/08711* (2013.01); *G03G 9/08748* (2013.01); *G03G 9/08795* (2013.01); *G03G 9/08797* (2013.01)

(58) Field of Classification Search
CPC ..... G03G 9/08755; G03G 9/08711; G03G 9/081; G03G 9/08748
USPC ..... 430/108.4, 137.18, 137.2
See application file for complete search history.

(56) References Cited

U.S. PATENT DOCUMENTS 5,314,777 A * 5/1994 Watanabe ..... G03G 9/08711 430/108.15
5,965,313 A * 10/1999 Mizutani ..... G03G 9/08795 430/108.4
6,432,600 B2 8/2002 Suwa et al.
9,448,499 B2 9/2016 Kihira et al.
2001/0003636 A1 6/2001 Suwa et al.
2003/0165764 A1 9/2003 Suwa et al.
2012/0148951 A1* 6/2012 Qiu ..... C08J 3/05 430/137.14
2012/0295196 A1* 11/2012 Urban ..... G03G 9/08711 430/111.4
2013/0202996 A1* 8/2013 Yamauchi ..... G03G 9/0821 430/105
2014/0023965 A1 1/2014 Chiba et al.
2014/0170552 A1 6/2014 Shintou et al.
2015/0261109 A1* 9/2015 Kihira ..... G03G 9/08 430/108.1

FOREIGN PATENT DOCUMENTS

JP 2000242030 A 9/2000
JP 2001166537 A 6/2001
JP 2003248339 A 9/2003
JP 2004093829 A 3/2004
JP 2006070057 A 3/2006
JP 2011095471 A 5/2011
JP 2012032628 A 2/2012
JP 2012145642 A 8/2012
JP 2014028882 A 2/2014
JP 2014041324 A 3/2014

OTHER PUBLICATIONS

Yasuhara Chemical Co., Ltd., Terpene Phenolic Resin product sheet, copyright 2014, at http://www.yschem.co.jp/english/products/resin/terprene_phenol.html.*

U.S. Appl. No. 14/611,867; First Named Inventor: Kenji Kihira; Title: "Electrophotographic Toner Using Bioplastic and Method of Producing the Same"; filed Feb. 2, 2015.

* cited by examiner

*Primary Examiner* — Janis L Dote
(74) *Attorney, Agent, or Firm* — Holtz, Holtz & Volek PC

(57) ABSTRACT

An electrophotographic toner which is excellent in grindability, fixing property and durability by being obtained via a step of melt-kneading a mixture containing an amorphous bioplastic having a weight-average molecular weight (Mw) of 55000 to 120000, a terpene phenol resin, and a styrene acrylic resin having a weight-average molecular weight (Mw) of 85500 to 118000 so as to obtain a kneaded mixture, and a step of grinding the kneaded mixture after hardening.

10 Claims, 19 Drawing Sheets

FIG. 3(a)

| | Toner mother body blending ratio | | | | | | |
|---|---|---|---|---|---|---|---|
| | Binding resin | | | | | | |
| | PLA resin | | | | | | |
| | Molecular weight: 150000 | Molecular weight: 130000 | Molecular weight: 120000 | Molecular weight: 80000 | Molecular weight: 55000 | Molecular weight: 50000 | Molecular weight: 30000 |
| | Blending amount (parts) | Blending amount (parts) | Blending amount (parts) | Blending amount (parts) | Blending amount (parts) | Blending amount (parts) | Blending amount (parts) |
| Example 1 | | | | 51 | | | |
| Example 2 | | | | 51 | | | |
| Example 3 | | | | 51 | | | |
| Example 4 | | | | 51 | | | |
| Example 5 | | | | 53 | | | |
| Example 6 | | | | 49 | | | |
| Example 7 | | | | 53 | | | |
| Example 8 | | | | 49 | | | |
| Example 9 | | | | 53 | | | |
| Example 10 | | | | 49 | | | |
| Example 11 | | | | 53 | | | |
| Example 12 | | | | 49 | | | |
| Example 13 | | | 51 | | | | |
| Example 14 | | | | | 51 | | |
| Example 15 | | | | 51 | | | |
| Example 16 | | | | 46 | | | |
| Example 17 | | | | 56 | | | |
| Example 18 | | | | | 46 | | |
| Example 19 | | | | | 56 | | |

FIG. 3(b)

| | Toner mother body blending ratio | | | | |
|---|---|---|---|---|---|
| | Grinding aid 1 | | | | |
| | Terpene phenol resin | Terpene phenol resin | Terpene phenol resin | Terpene hydrogen-ated resin | Rosin ester resin |
| | YS Polystar N125 | YS Polystar G150 | YS Polystar U115 | Clearon P135 | Pensel D135 |
| | Blending amount (parts) | Blending amount (parts) | Blending amount (parts) | Blending amount (parts) | Blending amount (parts) |
| Example 1 | 20 | | | | |
| Example 2 | 20 | | | | |
| Example 3 | 20 | | | | |
| Example 4 | 20 | | | | |
| Example 5 | 20 | | | | |
| Example 6 | 20 | | | | |
| Example 7 | 20 | | | | |
| Example 8 | 20 | | | | |
| Example 9 | 20 | | | | |
| Example 10 | 20 | | | | |
| Example 11 | 20 | | | | |
| Example 12 | 20 | | | | |
| Example 13 | 20 | | | | |
| Example 14 | 20 | | | | |
| Example 15 | | 20 | | | |
| Example 16 | 25 | | | | |
| Example 17 | 15 | | | | |
| Example 18 | | 25 | | | |
| Example 19 | | 15 | | | |

FIG. 3(c)

| | Toner mother body blending ratio | | | | | | | |
|---|---|---|---|---|---|---|---|---|
| | Grinding aid 2 | | | | | | | |
| | Styrene acrylic resin | | | | | | | |
| | Molecular weight of FSR-020: 34500 | Molecular weight of FSR-044: 13200 | Molecular weight of FSR-051: 85500 | Molecular weight of FSR-053: 400000 | Molecular weight of FSR-055: 118000 | Molecular weight of TIZ-470: 180000 | Molecular weight of FB-676: 112000 | Molecular weight of FB-1157: 110000 |
| | Blending amount (parts) | Blending amount (parts) | Blending amount (parts) | Blending amount (parts) | Blending amount (parts) | Blending amount (parts) | Blending amount (parts) | Blending amount (parts) |
| Example 1 | | | 10 | | | | | |
| Example 2 | | | | | 10 | | | |
| Example 3 | | | | | | | 10 | |
| Example 4 | | | | | | | | 10 |
| Example 5 | | | 8 | | | | | |
| Example 6 | | | 12 | | | | | |
| Example 7 | | | | | 8 | | | |
| Example 8 | | | | | 12 | | | |
| Example 9 | | | | | | | 8 | |
| Example 10 | | | | | | | 12 | |
| Example 11 | | | | | | | | 8 |
| Example 12 | | | | | | | | 12 |
| Example 13 | | | 10 | | | | | |
| Example 14 | | | 10 | | | | | |
| Example 15 | | | 10 | | | | | |
| Example 16 | | | 10 | | | | | |
| Example 17 | | | 10 | | | | | |
| Example 18 | | | 10 | | | | | |
| Example 19 | | | 10 | | | | | |

FIG. 3(d)

| | | | Coloring agent | Mold release agent | Charge controlling agent | Total |
|---|---|---|---|---|---|---|
| | | | Pigment master batch | | | |
| | Molecular weight of FB-1760: 67000 | Molecular weight of FB-1765: 260000 | Master batch of magenta R269 of 40% concentration | Carnauba wax | LR-147 | |
| | Blending amount (parts) | Blending amount (parts) | Blending amount (parts) | Blending amount (parts) | Blending amount (parts) | Total amount of internal additives |
| Example 1 | | | 12 | 6 | 1 | 100 |
| Example 2 | | | ↑ | ↑ | ^ | 100 |
| Example 3 | | | ↑ | ↑ | ^ | 100 |
| Example 4 | | | ↑ | ↑ | ^ | 100 |
| Example 5 | | | ↑ | ↑ | ^ | 100 |
| Example 6 | | | ↑ | ↑ | ^ | 100 |
| Example 7 | | | ↑ | ↑ | ^ | 100 |
| Example 8 | | | ↑ | ↑ | ^ | 100 |
| Example 9 | | | ↑ | ↑ | ^ | 100 |
| Example 10 | | | ↑ | ↑ | ^ | 100 |
| Example 11 | | | ↑ | ↑ | ^ | 100 |
| Example 12 | | | ↑ | ↑ | ^ | 100 |
| Example 13 | | | ↑ | ↑ | ^ | 100 |
| Example 14 | | | ↑ | ↑ | ^ | 100 |
| Example 15 | | | ↑ | ↑ | ^ | 100 |
| Example 16 | | | ↑ | ↑ | ^ | 100 |
| Example 17 | | | ↑ | ↑ | ^ | 100 |
| Example 18 | | | ↑ | ↑ | ^ | 100 |
| Example 19 | | | ↑ | ↑ | ^ | 100 |

FIG. 3(e)

| | External additive blending ratio (blending amount with respect to mother body) | | | Evaluation result | | | |
|---|---|---|---|---|---|---|---|
| | Hydrophobic silica | | | Evaluation of production efficie-ncy | Evaluation of performance | | Total result |
| | RY50 (40nm) | TG810G (7nm) | TG-C191 (115nm) | Grinda-bility | Fixing proper-ty | Durabi-lity | |
| | Blending amount (parts) | Blending amount (parts) | Blending amount (parts) | | | | |
| Example 1 | 2.5 | 0.3 | 1.3 | ◎ | ○ | ○ | ◎ |
| Example 2 | ↑ | ↑ | ↑ | ◎ | ○ | ○ | ◎ |
| Example 3 | ↑ | ↑ | ↑ | ◎ | ○ | ○ | ◎ |
| Example 4 | ↑ | ↑ | ↑ | ◎ | ○ | ○ | ◎ |
| Example 5 | ↑ | ↑ | ↑ | ○ | ○ | ○ | ○ |
| Example 6 | ↑ | ↑ | ↑ | ◎ | ○ | ○ | ◎ |
| Example 7 | ↑ | ↑ | ↑ | ○ | ○ | ○ | ○ |
| Example 8 | ↑ | ↑ | ↑ | ◎ | ○ | ○ | ◎ |
| Example 9 | ↑ | ↑ | ↑ | ○ | ○ | ○ | ○ |
| Example 10 | ↑ | ↑ | ↑ | ◎ | ○ | ○ | ◎ |
| Example 11 | ↑ | ↑ | ↑ | ○ | ○ | ○ | ○ |
| Example 12 | ↑ | ↑ | ↑ | ◎ | ○ | ○ | ◎ |
| Example 13 | ↑ | ↑ | ↑ | ◎ | ○ | ○ | ◎ |
| Example 14 | ↑ | ↑ | ↑ | ○ | ○ | ○ | ○ |
| Example 15 | ↑ | ↑ | ↑ | ○ | ○ | ○ | ○ |
| Example 16 | ↑ | ↑ | ↑ | ○ | ○ | ○ | ○ |
| Example 17 | ↑ | ↑ | ↑ | ○ | ○ | ○ | ○ |
| Example 18 | ↑ | ↑ | ↑ | ○ | ○ | ○ | ○ |
| Example 19 | ↑ | ↑ | ↑ | ○ | ○ | ○ | ○ |

FIG. 3(f)

| | | | | |
|---|---|---|---|---|
| 3(a) | 3(b) | 3(c) | 3(d) | 3(e) |

FIG. 4(a)

| | Toner mother body blending ratio | | | | | | |
|---|---|---|---|---|---|---|---|
| | Binding resin | | | | | | |
| | PLA resin | | | | | | |
| | Molecular weight: 150000 | Molecular weight: 130000 | Molecular weight: 120000 | Molecular weight: 80000 | Molecular weight: 55000 | Molecular weight: 50000 | Molecular weight: 30000 |
| | Blending amount (parts) | Blending amount (parts) | Blending amount (parts) | Blending amount (parts) | Blending amount (parts) | Blending amount (parts) | Blending amount (parts) |
| Comparative example 1 | | | | 81 | | | |
| Comparative example 2 | | | | | 81 | | |
| Comparative example 3 | | | | 81 | | | |
| Comparative example 4 | | | | 51 | | | |
| Comparative example 5 | | | | 51 | | | |
| Comparative example 6 | | | | 51 | | | |
| Comparative example 7 | | | | 41 | | | |
| Comparative example 8 | | | | 31 | | | |
| Comparative example 9 | | | | 61 | | | |
| Comparative example 10 | | | | | | | 61 |
| Comparative example 11 | | | | | | 61 | |
| Comparative example 12 | | | | | | 51 | |
| Comparative example 13 | | | | | 61 | | |
| Comparative example 14 | | | | 61 | | | |
| Comparative example 15 | | | 61 | | | | |
| Comparative example 16 | | 61 | | | | | |
| Comparative example 17 | | 51 | | | | | |
| Comparative example 18 | 61 | | | | | | |

FIG. 4(b)

| | Toner mother body blending ratio | | | | | | |
|---|---|---|---|---|---|---|---|
| | Binding resin | | | | | | |
| | PLA resin | | | | | | |
| | Molecular weight: 150000 | Molecular weight: 130000 | Molecular weight: 120000 | Molecular weight: 80000 | Molecular weight: 55000 | Molecular weight: 50000 | Molecular weight: 30000 |
| | Blending amount (parts) | Blending amount (parts) | Blending amount (parts) | Blending amount (parts) | Blending amount (parts) | Blending amount (parts) | Blending amount (parts) |
| Comparative example 19 | | | | | 61 | | |
| Comparative example 20 | | | | 61 | | | |
| Comparative example 21 | | | 61 | | | | |
| Comparative example 22 | | | | 41 | | | |
| Comparative example 23 | | | | 31 | | | |
| Comparative example 24 | | | | 56 | | | |
| Comparative example 25 | | | | 41 | | | |
| Comparative example 26 | | | | 31 | | | |
| Comparative example 27 | | | | 51 | | | |
| Comparative example 28 | | | | 51 | | | |
| Comparative example 29 | | | | 51 | | | |
| Comparative example 30 | | | | 51 | | | |
| Comparative example 31 | | | | 51 | | | |
| Comparative example 32 | | | | 51 | | | |
| Comparative example 33 | | | | 53 | | | |
| Comparative example 34 | | | | 49 | | | |
| Comparative example 35 | | | 51 | | | | |
| Comparative example 36 | | | | | 51 | | |

FIG. 4(c)

| | Grinding aid 1 | | | | |
|---|---|---|---|---|---|
| | Terpene phenol resin | Terpene phenol resin | Terpene phenol resin | Terpene hydrogen-ated resin | Rosin ester resin |
| | YS Polystar N125 | YS Polystar G150 | YS Polystar U115 | Clearon P135 | Pensel D135 |
| | Blending amount (parts) | Blending amount (parts) | Blending amount (parts) | Blending amount (parts) | Blending amount (parts) |
| Comparative example 1 | | | | | |
| Comparative example 2 | | | | | |
| Comparative example 3 | | | | | |
| Comparative example 4 | | | 20 | | |
| Comparative example 5 | | | | 20 | |
| Comparative example 6 | | | | | 20 |
| Comparative example 7 | 30 | | | | |
| Comparative example 8 | 40 | | | | |
| Comparative example 9 | 10 | | | | |
| Comparative example 10 | 20 | | | | |
| Comparative example 11 | 20 | | | | |
| Comparative example 12 | 20 | | | | |
| Comparative example 13 | 20 | | | | |
| Comparative example 14 | 20 | | | | |
| Comparative example 15 | 20 | | | | |
| Comparative example 16 | 20 | | | | |
| Comparative example 17 | 20 | | | | |
| Comparative example 18 | 20 | | | | |

FIG. 4(d)

| | Grinding aid 1 | | | | |
|---|---|---|---|---|---|
| | Terpene phenol resin | Terpene phenol resin | Terpene phenol resin | Terpene hydrogen-ated resin | Rosin ester resin |
| | YS Polystar N125 | YS Polystar G150 | YS Polystar U115 | Clearon P135 | Pensel D135 |
| | Blending amount (parts) | Blending amount (parts) | Blending amount (parts) | Blending amount (parts) | Blending amount (parts) |
| Comparative example 19 | | 20 | | | |
| Comparative example 20 | | 20 | | | |
| Comparative example 21 | | 20 | | | |
| Comparative example 22 | 20 | | | | |
| Comparative example 23 | 20 | | | | |
| Comparative example 24 | 20 | | | | |
| Comparative example 25 | | 20 | | | |
| Comparative example 26 | | 20 | | | |
| Comparative example 27 | 20 | | | | |
| Comparative example 28 | 20 | | | | |
| Comparative example 29 | 20 | | | | |
| Comparative example 30 | 20 | | | | |
| Comparative example 31 | 20 | | | | |
| Comparative example 32 | 20 | | | | |
| Comparative example 33 | 20 | | | | |
| Comparative example 34 | 20 | | | | |
| Comparative example 35 | 20 | | | | |
| Comparative example 36 | 20 | | | | |

FIG. 4(e)

| | Toner mother body blending ratio | | | | | | | |
|---|---|---|---|---|---|---|---|---|
| | Grinding aid 2 | | | | | | | |
| | Styrene acrylic resin | | | | | | | |
| | Molecular weight of FSR-020: 34500 | Molecular weight of FSR-044: 13200 | Molecular weight of FSR-051: 85500 | Molecular weight of FSR-053: 400000 | Molecular weight of FSR-055: 118000 | Molecular weight of TIZ-470: 180000 | Molecular weight of FB-676: 112000 | Molecular weight of FB-1157: 110000 |
| | Blending amount (parts) | Blending amount (parts) | Blending amount (parts) | Blending amount (parts) | Blending amount (parts) | Blending amount (parts) | Blending amount (parts) | Blending amount (parts) |
| Comparative example 1 | | | 10 | | | | | |
| Comparative example 2 | | | 10 | | | | | |
| Comparative example 3 | | | | | 10 | | | |
| Comparative example 4 | | | 10 | | | | | |
| Comparative example 5 | | | 10 | | | | | |
| Comparative example 6 | | | 10 | | | | | |
| Comparative example 7 | | | 10 | | | | | |
| Comparative example 8 | | | 10 | | | | | |
| Comparative example 9 | | | 10 | | | | | |
| Comparative example 10 | | | | | | | | |
| Comparative example 11 | | | | | | | | |
| Comparative example 12 | | | 10 | | | | | |
| Comparative example 13 | | | | | | | | |
| Comparative example 14 | | | | | | | | |
| Comparative example 15 | | | | | | | | |
| Comparative example 16 | | | | | | | | |
| Comparative example 17 | | | 10 | | | | | |
| Comparative example 18 | | | | | | | | |

FIG. 4(f)

| | Toner mother body blending ratio | | | | | | | |
|---|---|---|---|---|---|---|---|---|
| | Grinding aid 2 | | | | | | | |
| | Styrene acrylic resin | | | | | | | |
| | Molecular weight of FSR-020: 34500 | Molecular weight of FSR-044: 13200 | Molecular weight of FSR-051: 85500 | Molecular weight of FSR-053: 400000 | Molecular weight of FSR-055: 118000 | Molecular weight of TIZ-470: 180000 | Molecular weight of FB-676: 112000 | Molecular weight of FB-1157: 110000 |
| | Blending amount (parts) | Blending amount (parts) | Blending amount (parts) | Blending amount (parts) | Blending amount (parts) | Blending amount (parts) | Blending amount (parts) | Blending amount (parts) |
| Comparative example 19 | | | | | | | | |
| Comparative example 20 | | | | | | | | |
| Comparative example 21 | | | | | | | | |
| Comparative example 22 | | | 20 | | | | | |
| Comparative example 23 | | | 30 | | | | | |
| Comparative example 24 | | | 5 | | | | | |
| Comparative example 25 | | | | | 20 | | | |
| Comparative example 26 | | | | | 30 | | | |
| Comparative example 27 | 10 | | | | | | | |
| Comparative example 28 | | 10 | | | | | | |
| Comparative example 29 | | | | 10 | | | | |
| Comparative example 30 | | | | | | 10 | | |
| Comparative example 31 | | | | | | | | |
| Comparative example 32 | | | | | | | | |
| Comparative example 33 | 8 | | | | | | | |
| Comparative example 34 | 12 | | | | | | | |
| Comparative example 35 | | | | 10 | | | | |
| Comparative example 36 | | | | 10 | | | | |

FIG. 4(g)

| | | | Coloring agent | Mold release agent | Charge controll-ing agent | Total |
|---|---|---|---|---|---|---|
| | | | Pigment master batch | | | |
| | Molecu-lar weight of FB-1760: 67000 | Molecu-lar weight of FB-1765: 260000 | Master batch of magenta R269 of 40% concent-ration | Carnauba wax | LR-147 | |
| | Blending amount (parts) | Blending amount (parts) | Blending amount (parts) | Blending amount (parts) | Blending amount (parts) | Total amount of internal additives |
| Comparative example 1 | | | ↑ | ↑ | ^ | 100 |
| Comparative example 2 | | | ↑ | ↑ | ^ | 100 |
| Comparative example 3 | | | ↑ | ↑ | ^ | 100 |
| Comparative example 4 | | | ↑ | ↑ | ^ | 100 |
| Comparative example 5 | | | ↑ | ↑ | ^ | 100 |
| Comparative example 6 | | | ↑ | ↑ | ^ | 100 |
| Comparative example 7 | | | ↑ | ↑ | ^ | 100 |
| Comparative example 8 | | | ↑ | ↑ | ^ | 100 |
| Comparative example 9 | | | ↑ | ↑ | ^ | 100 |
| Comparative example 10 | | | ↑ | ↑ | ^ | 100 |
| Comparative example 11 | | | ↑ | ↑ | ^ | 100 |
| Comparative example 12 | | | ↑ | ↑ | ^ | 100 |
| Comparative example 13 | | | ↑ | ↑ | ^ | 100 |
| Comparative example 14 | | | ↑ | ↑ | ^ | 100 |
| Comparative example 15 | | | ↑ | ↑ | ^ | 100 |
| Comparative example 16 | | | ↑ | ↑ | ^ | 100 |
| Comparative example 17 | | | ↑ | ↑ | ^ | 100 |
| Comparative example 18 | | | ↑ | ↑ | ^ | 100 |

FIG. 4(h)

| | | | Coloring agent | Mold release agent | Charge controlling agent | Total |
|---|---|---|---|---|---|---|
| | | | Pigment master batch | | | |
| | Molecular weight of FB-1760: 67000 | Molecular weight of FB-1765: 260000 | Master batch of magenta R269 of 40% concentration | Carnauba wax | LR-147 | |
| | Blending amount (parts) | Blending amount (parts) | Blending amount (parts) | Blending amount (parts) | Blending amount (parts) | Total amount of internal additives |
| Comparative example 19 | | | ↑ | ↑ | ↑ | 100 |
| Comparative example 20 | | | ↑ | ↑ | ↑ | 100 |
| Comparative example 21 | | | ↑ | ↑ | ↑ | 100 |
| Comparative example 22 | | | ↑ | ↑ | ↑ | 100 |
| Comparative example 23 | | | ↑ | ↑ | ↑ | 100 |
| Comparative example 24 | | | ↑ | ↑ | ↑ | 100 |
| Comparative example 25 | | | ↑ | ↑ | ↑ | 101 |
| Comparative example 26 | | | ↑ | ↑ | ↑ | 102 |
| Comparative example 27 | | | ↑ | ↑ | ↑ | 100 |
| Comparative example 28 | | | ↑ | ↑ | ↑ | 100 |
| Comparative example 29 | | | ↑ | ↑ | ↑ | 100 |
| Comparative example 30 | | | ↑ | ↑ | ↑ | 100 |
| Comparative example 31 | 10 | | ↑ | ↑ | ↑ | 100 |
| Comparative example 32 | | 10 | ↑ | ↑ | ↑ | 100 |
| Comparative example 33 | | | ↑ | ↑ | ↑ | 100 |
| Comparative example 34 | | | ↑ | ↑ | ↑ | 100 |
| Comparative example 35 | | | ↑ | ↑ | ↑ | 100 |
| Comparative example 36 | | | ↑ | ↑ | ↑ | 100 |

FIG. 4(i)

| | External additive blending ratio (blending amount with respect to mother body) | | | Evaluation result | | | |
|---|---|---|---|---|---|---|---|
| | Hydrophobic silica | | | Evaluation of production efficie-ncy | Evaluation of performance | | Total result |
| | RY50 (40nm) | TG810G (7nm) | TG-C191 (115nm) | Grinda-bility | Fixing proper-ty | Durabi-lity | |
| | Blending amount (parts) | Blending amount (parts) | Blending amount (parts) | | | | |
| Comparative example 1 | ↑ | ↑ | ↑ | △ | △ | ○ | △ |
| Comparative example 2 | ↑ | ↑ | ↑ | △ | △ | ○ | △ |
| Comparative example 3 | ↑ | ↑ | ↑ | △ | △ | ○ | △ |
| Comparative example 4 | ↑ | ↑ | ↑ | △ | △ | × | × |
| Comparative example 5 | ↑ | ↑ | ↑ | △ | △ | × | × |
| Comparative example 6 | ↑ | ↑ | ↑ | △ | △ | × | × |
| Comparative example 7 | ↑ | ↑ | ↑ | ○ | × | × | × |
| Comparative example 8 | ↑ | ↑ | ↑ | ○ | × | × | × |
| Comparative example 9 | ↑ | ↑ | ↑ | × | ○ | ○ | × |
| Comparative example 10 | ↑ | ↑ | ↑ | - | - | - | × |
| Comparative example 11 | ↑ | ↑ | ↑ | ○ | × | × | × |
| Comparative example 12 | ↑ | ↑ | ↑ | △ | △ | △ | △ |
| Comparative example 13 | ↑ | ↑ | ↑ | △ | ○ | ○ | △ |
| Comparative example 14 | ↑ | ↑ | ↑ | △ | ○ | ○ | △ |
| Comparative example 15 | ↑ | ↑ | ↑ | △ | ○ | ○ | △ |
| Comparative example 16 | ↑ | ↑ | ↑ | × | △ | △ | × |
| Comparative example 17 | ↑ | ↑ | ↑ | △ | △ | △ | △ |
| Comparative example 18 | ↑ | ↑ | ↑ | × | - | - | × |

FIG. 4(j)

| | External additive blending ratio (blending amount with respect to mother body) | | | Evaluation result | | | |
|---|---|---|---|---|---|---|---|
| | Hydrophobic silica | | | Evaluation of production efficie-ncy | Evaluation of performance | | Total result |
| | RY50 (40nm) | TG810G (7nm) | TG-C191 (115nm) | Grinda-bility | Fixing proper-ty | Durabi-lity | |
| | Blending amount (parts) | Blending amount (parts) | Blending amount (parts) | | | | |
| Comparative example 19 | ↑ | ↑ | ↑ | △ | ○ | ○ | △ |
| Comparative example 20 | ↑ | ↑ | ↑ | △ | ○ | ○ | △ |
| Comparative example 21 | ↑ | ↑ | ↑ | △ | ○ | ○ | △ |
| Comparative example 22 | ↑ | ↑ | ↑ | ○ | △ | ○ | × |
| Comparative example 23 | ↑ | ↑ | ↑ | ○ | △ | ○ | × |
| Comparative example 24 | ↑ | ↑ | ↑ | × | ○ | ○ | × |
| Comparative example 25 | ↑ | ↑ | ↑ | ○ | △ | ○ | × |
| Comparative example 26 | ↑ | ↑ | ↑ | ○ | △ | ○ | × |
| Comparative example 27 | ↑ | ↑ | ↑ | ○ | × | × | × |
| Comparative example 28 | ↑ | ↑ | ↑ | ○ | × | × | × |
| Comparative example 29 | ↑ | ↑ | ↑ | × | △ | ○ | × |
| Comparative example 30 | ↑ | ↑ | ↑ | × | ○ | ○ | × |
| Comparative example 31 | ↑ | ↑ | ↑ | △ | ○ | △ | × |
| Comparative example 32 | ↑ | ↑ | ↑ | × | ○ | ○ | × |
| Comparative example 33 | ↑ | ↑ | ↑ | ○ | × | × | × |
| Comparative example 34 | ↑ | ↑ | ↑ | ○ | × | × | × |
| Comparative example 35 | ↑ | ↑ | ↑ | × | ○ | ○ | × |
| Comparative example 36 | ↑ | ↑ | ↑ | × | ○ | ○ | × |

FIG. 4(k)

| | | | | |
|---|---|---|---|---|
| 4(a) | 4(c) | 4(e) | 4(g) | 4(i) |
| 4(b) | 4(d) | 4(f) | 4(h) | 4(j) |

ELECTROPHOTOGRAPHIC TONER USING BIOPLASTIC AND PRODUCTION METHOD THEREOF

CROSS-REFERENCE TO RELATED APPLICATION

This application is based upon and claims the benefit of priority from the prior Japanese Patent Application No. 2014-120407, filed Jun. 11, 2014, the entire contents of which are incorporated herein by reference.

BACKGROUND OF THE INVENTION

1. Field of the Invention

The present invention relates to an electrophotographic toner using a bioplastic and a production method thereof.

2. Description of the Related Art

In image formation according to electrophotographic mode, an electrostatically charged image is developed by a toner to be visualized. The toner image obtained by development is transferred onto paper and then fixed by heat and pressure. The above-described toner is produced by melt-kneading a mixture prepared by blending a coloring agent, a charge controlling agent and the like in a binding resin, and grinding and classifying the kneaded mixture to give prescribed particle size distribution. As the binding resin for the toner as described above, petroleum-derived resins such as styrene acrylic resins and polyester resins have been conventionally used.

Recently, there has been proposed a method in which biodegradable resins generating little load on environments in disposal and biomass plastics produced from recyclable resources are used as the toner resin, in consideration of environments. Here, biomass plastics and biodegradable plastics capable of effectively utilizing finite resources and contributing to reduction of environmental load are called a bioplastic.

Among bioplastics, polylactic acid is one of presently most promising resins. Polylactic acid is a crystalline polyester having a melting point of about 170° C., a glass transition temperature of about 60° C. and a weight-average molecular weight (Mw) of about 150000. A method where such polylactic acid is endowed with heat resistance and high durability and used in the main frame of a mobile telephone and the like has also been started to be used. When the above-described polylactic acid is used as it is as a toner resin, the grindability thereof is poor because of its hardness. In addition, because the softening temperature is high, it is unsuitable for low temperature fixity.

Japanese Patent Application Laid-Open (Kokai) Publication No. 2001-166537 discloses a technique where a toner excellent in a low temperature fixing property and having improved durability is obtained by the content ratio of a specific polylactic biodegradable resin to a terpene phenol copolymer being adjusted to 80:20 to 20:80.

Also, Japanese Patent Application Laid-Open (Kokai) Publication No. 2003-248339 discloses a technique where an excellent low temperature fixing property is attained without losing durability by blending a terpene phenol copolymer in a specific polylactic biodegradable resin in the same manner as described above, and additionally blending a prescribed amount (7% to 20%) of wax having a melting point not higher than its softening temperature.

Moreover, Japanese Patent Application Laid-Open (Kokai) Publication No. 2004-093829 discloses a technique where a low temperature fixable toner exhibiting little temporal change is obtained by containing a specific polylactic biodegradable resin and a terpene phenol copolymer and adding 1 to 3% of inorganic fine particles as the external additive.

However, it has been ascertained by studies of the inventors of the present invention that, when polylactic acids described in examples of the above-described techniques are used, high grindability cannot be accomplished easily and toner formation is difficult.

Also, Japanese Patent Application Laid-Open (Kokai) Publication No. 2012-032628 proposes a technique where the molecular weight is lowered to improve grindability by hydrolyzing polylactic acid. However, hydrolysis of polylactic acid needs a long treatment time, and therefore the workability and cost phase thereof are highly disadvantageous.

SUMMARY OF THE INVENTION

In accordance with one aspect of the present invention, there is provided an electrophotographic toner comprising: an amorphous bioplastic having a weight-average molecular weight (Mw) of 55000 to 120000, a terpene phenol resin, and a styrene acrylic resin having a weight-average molecular weight (Mw) of 85500 to 118000.

In accordance with another aspect of the present invention, there is provided a method of producing an electrophotographic toner, comprising: a step of melt-kneading a mixture containing an amorphous bioplastic having a weight-average molecular weight (Mw) of 55000 to 120000, a terpene phenol resin, and a styrene acrylic resin having a weight-average molecular weight (Mw) of 85500 to 118000, so as to obtain a kneaded mixture; and a step of grinding the kneaded mixture after hardening.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more deeply understood by the detailed description below being considered together with the following drawings.

FIG. 3 (*a*) to FIG. 3 (*e*) are diagrams constituting an outsized table divided into subsections showing examples of the present invention and FIG. 3 (*f*) is an additional drawing that indicates the manner in which the subsections FIG. 3 (*a*) to FIG. 3 (*e*) fit together as a whole; and FIG. 4 (*a*) to FIG. 4 (*j*) are diagrams constituting an outsized table divided into subsections showing comparative examples of the present invention and FIG. 4 (*k*) is an additional drawing that indicates the manner in which the subsections FIG. 4 (*a*) to FIG. 4 (*j*) fit together as a whole.

DETAILED DESCRIPTION OF THE PREFERRED EMBODIMENTS

Embodiments of the present invention are hereinafter described.

In general, in production of an electrophotographic toner using a crystalline bioplastic as a binding resin, it is difficult to attain high grindability without the molecular weight of the bioplastic being fairly low.

However, the present inventors have found that, even if the molecular weight of a bioplastic is not so low, high grindability can be attained by a styrene acrylic resin having specific molecular weight being further combined with a combination of an amorphous bioplastic and a terpene phenol resin, based on which the present invention has been conceived.

Specifically, the electrophotographic toner according to an embodiment of the present invention is characterized by including an amorphous bioplastic having a weight-average molecular weight (Mw) of 55000 to 120000, a terpene phenol resin, and a styrene acrylic resin having a weight-average molecular weight (Mw) of 85500 to 118000.

In the present embodiment, the amorphous bioplastic is used as the main component of a binding resin. As the amorphous bioplastic, for example, amorphous polylactic acid can be used. The amorphous bioplastic in the present embodiment may also be a bioplastic produced by using polylactic resin obtained from corn and cassava.

Note that the amorphous bioplastic denotes a bioplastic showing no exothermic peak in the DSC (differential scanning calorimetry) curve obtained by performing DSC. In contrast, the crystalline bioplastic denotes a bioplastic showing an exothermic peak in the DSC curve.

Figure 1:
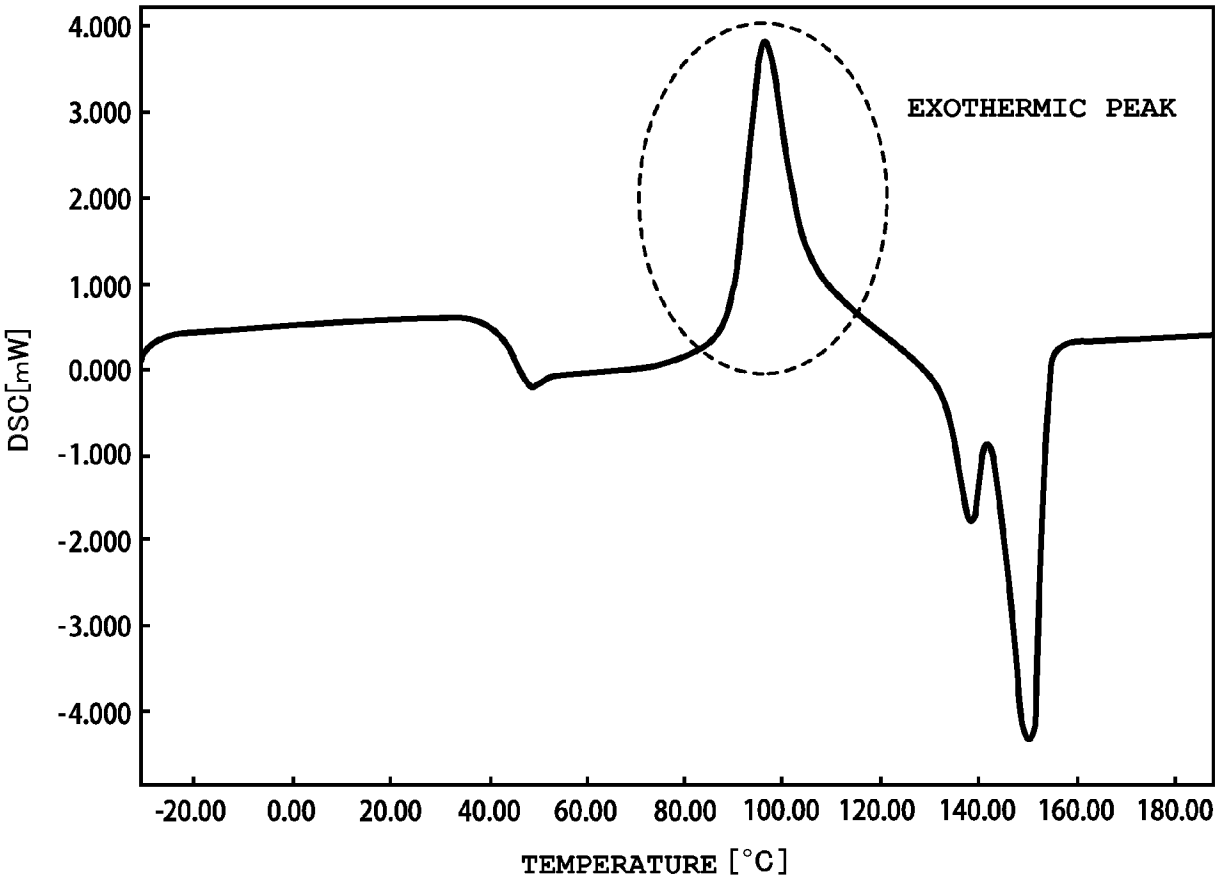
FIG. 1 is a diagram showing a DSC (differential scanning calorimetry) curve of crystalline polylactic acid.
Figure 2:
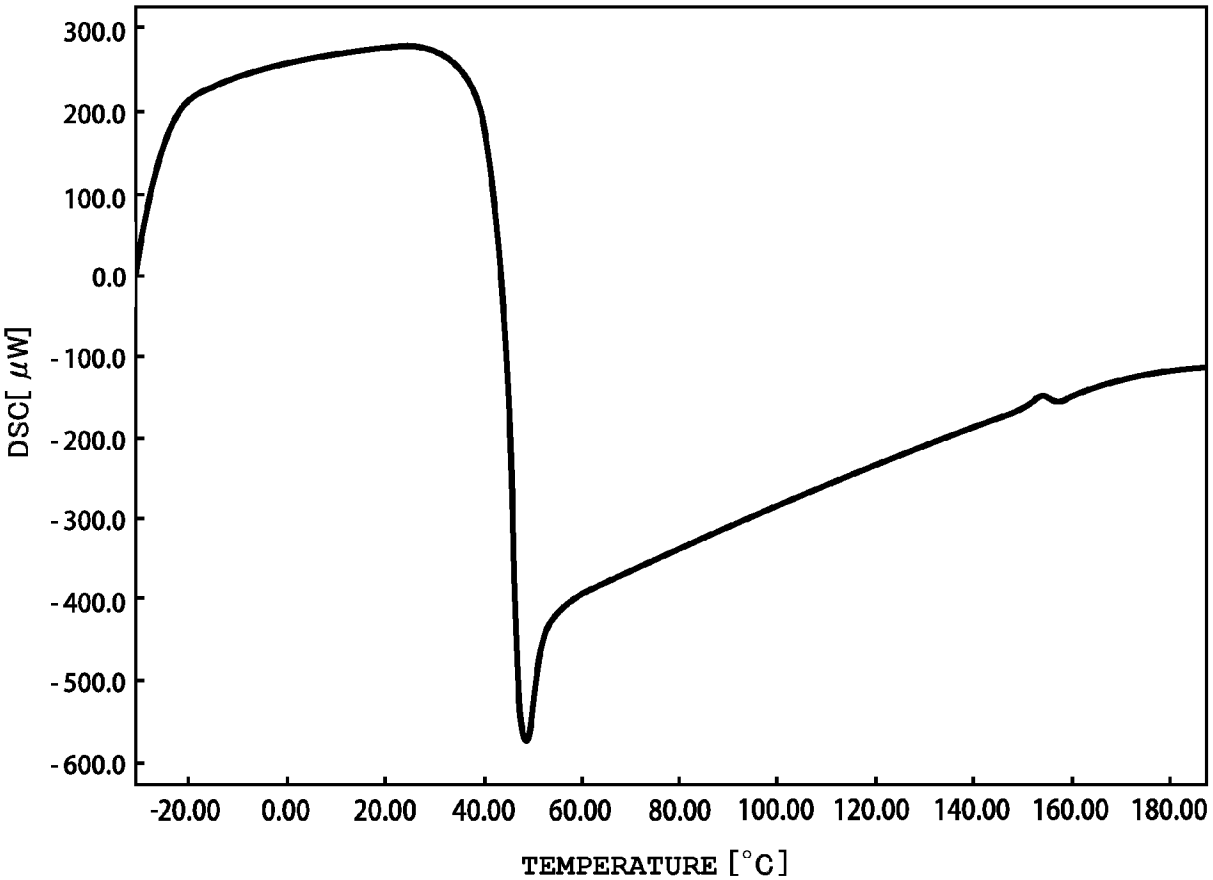
FIG. 2 is a diagram showing a DSC (differential scanning calorimetry) curve of amorphous polylactic acid.

FIG. 1 shows the DSC curve of crystalline polylactic acid and FIG. 2 shows the DSC curve of amorphous polylactic acid. As shown in FIG. 1 and FIG. 2, an exothermic peak is observed in the DSC curve of crystalline polylactic acid, while an exothermic peak is not observed in the DSC curve of amorphous polylactic acid.

The toner according to the present embodiment does not contain a crystalline bioplastic in a typical occasion. This is because when, for example, a crystalline bioplastic and an amorphous bioplastic having the same molecular weight are compared, the crystalline bioplastic is harder, and has poor grindability.

The amorphous bioplastic used in the present embodiment has preferably a weight-average molecular weight (Mw) in the range of 55000 to 120000. When the weight-average molecular weight (Mw) is excessively low, storability and durability as a toner cannot be maintained. In contrast, when the weight-average molecular weight (Mw) is excessively high, grindability is poor and toner production is difficult.

The amorphous bioplastic is contained, for example, in a proportion of 20 to 80% by mass with respect to the toner mass. Note that "toner mass" herein is defined as the total mass of toner raw materials (internal additives) including a binding resin, a grinding aid, and a coloring agent, and excluding external additives such as silica.

The toner according to the present embodiment contains a terpene phenol resin and a styrene acrylic resin as the grinding aid. Though a styrene acrylic resin is generally used as the binding resin for toner, it is regarded as the grinding aid in the present embodiment.

As the terpene phenol resin, for example, resins obtained by copolymerizing a terpene monomer and phenol can be used. Specifically, YS Polystar N125 (manufactured by Yasuhara Chemical Co., Ltd.), YS Polystar G150 (manufactured by Yasuhara Chemical Co., Ltd.) and the like can be used.

It is preferable that the weight-average degree of polymerization of these grinding aids is in the range of 500 to 5000. When the degree of polymerization is too small, thermal properties of the whole toner lower. When the degree of polymerization is too high, the whole toner becomes hard and grindability cannot be ensured.

The total amount of a terpene phenol resin and a styrene acrylic resin is, for example, in the range of 25 to 35% by mass with respect to the toner mass. When this total amount is small, the effect of enhancing grindability is not manifested remarkably. When this total amount is large, thermal properties as a toner lower remarkably, and defects occur in durability and a fixing property.

The total amount of a terpene phenol resin and a styrene acrylic resin is preferably in the range of 25 to 35% by mass with respect to the toner mass, and more preferably in the range of 28 to 32% by mass with respect to the toner mass. When the total amount of a terpene phenol resin and a styrene acrylic resin is in this range, a more excellent fixing property can be attained.

The toner of the present embodiment can further contain a coloring agent as a toner raw material. As the coloring agent, conventionally known compounds can be used. For example, the black coloring agent includes carbon black, the blue coloring agent includes C.I. Pigment 15:3, the red coloring agent includes C.I. Pigments 57:1, 122 and 269, the yellow coloring agent includes C.I. Pigments 74, 180 and 185, and the like. When environmental influences are taken into consideration, those showing high safety as the whole coloring agent are preferable.

The content of these coloring agents is preferably 1 to 10% by mass with respect to the toner mass. It may also be permissible that, prior to melt-kneading with a binding resin and the like, the coloring agent is dispersed at high concentration in a part of the resin to give a master batch, and mixed with the remaining resin and the like.

In the toner of the present embodiment, a mold release agent conventionally known can be added if necessary. Examples of such a mold release agent include olefin waxes such as polypropylene wax, polyethylene wax, and Fischer-Tropsch wax, natural waxes such as carnauba wax, rice bran wax, and Coccoidea wax, and synthetic ester waxes.

For improving a low temperature fixing property and quick printing performance, mold release agents having a melting point as relatively low as about 60 to 100° C. are preferable. More specifically, carnauba wax and synthetic ester waxes are preferable. When environmental influences are taken into consideration, carnauba wax as a natural material is more preferable. The blending amount of the mold release agent is preferably 1 to 15% by mass with respect to the toner mass.

Also, in the toner of the present embodiment, a charge controlling agent conventionally known can be added as its raw material, if necessary. For example, the positive charge controlling agent includes quaternary ammonium salts, resins containing an amino group, and the like, and the negative charge controlling agent includes metal complex salts of salicylic acid, metal complex salts of benzylic acid, calixarene type phenolic condensates, resins containing a carboxyl group, and the like. The addition amount of the charge controlling agent is preferably 0.1 to 5% by mass with respect to the toner mass.

Moreover, in the toner of the present embodiment, conventionally known polyester resins developed as the toner resin can also be added if necessary, from the standpoint of pigment dispersibility and a low temperature fixing property. The blending amount of these resins is preferably 0 to 50% by mass with respect to the toner mass when environmental influences are taken into consideration.

Furthermore, in the toner of the present embodiment, a hydrolysis inhibitor conventionally known can be added if necessary. Examples of the hydrolysis inhibitor include carbodiimide type compounds, isocyanate type compounds, and oxazoline type compounds. Such a hydrolysis inhibitor can block the residual monomer and the hydroxyl group terminal and the carboxyl group terminal generated by decomposition, and thereby suppress the chain reaction of hydrolysis.

As the hydrolysis inhibitor, a polycarbodiimide compound CARBODILITE LA-1 (manufactured by Nisshinbo Industries Inc.), and the like are being commercially marketed. The addition amount of the hydrolysis inhibitor is preferably 0.01 to 15% by mass, and more preferably 1 to 10% by mass with respect to a bioplastic.

Still further, in the toner of the present embodiment, a crystal nucleating agent conventionally known can be added if necessary. The crystal nucleating agent includes inorganic nucleating agents such as talc, and organic nucleating agents such as metal salts of organic carboxylic acids such as sodium benzoate, metal salts of phosphates, benzylidene sorbitol, carboxylic amides, and the like.

The electrophotographic toner described above can be produced by, for example, the following method.

First, a grinding aid composed of a terpene phenol resin and a styrene acrylic resin, a coloring agent, a mold release agent, and if necessary, raw materials including other additives are mixed with a binding resin containing an amorphous bioplastic. Thereafter, this is kneaded by a kneading machine such as a twin-screw kneader, a pressure kneader, or open rolls, so as to obtain a kneaded mixture. The kneaded mixture obtained is cooled, ground by a grinding mill such as a jet mill, and classified by an air classifier and the like, so that a toner can be obtained. Though the particle size of the toner is not particularly restricted, it is usually adjusted to 5 to 10 μm.

In the toner obtained as described above, external additives can be added for improvement of flowability, regulation of chargeability, and improvement of durability. As the external additive, inorganic fine particles, such as silica, titania, and alumina, are generally used. Among these inorganic fine particles, silica having undergone hydrophobization treatment (commercially available from Nippon Aerosil Co., Ltd. and CABOT corporation) is preferable. As the inorganic fine particles, those having a primary particle size of 7 to 40 nm are advantageous and, for functional improvement, two or more particles may be mixed.

EXAMPLES

The present invention will be described more specifically by examples of the present invention and comparative examples described below.

In the examples and comparative examples, amorphous polylactic acids were used as the amorphous bioplastic. Specifically, amorphous polylactic acids having weight-average molecular weight (Mw) of about 30000, about 50000, about 55000, about 80000, and about 120000 and crystalline polylactic acids having a weight-average molecular weight (Mw) of about 130000 and about 150000 were used. For the amorphous polylactic acids used, an exothermic peak was not observed in the DSC curve, as with the amorphous polylactic acid shown in FIG. 2.

<Fabrication of Toner>

Example 1

Fifty one (51) parts by mass of an amorphous polylactic resin "VYLOECOL BE-400" (manufactured by TOYOBO Co., Ltd.) having a weight-average molecular weight (Mw) of 80000 as the binding resin, 20 parts by mass of a terpene phenol resin "YS POLYSTAR N125" (manufactured by Yasuhara Chemical Co., Ltd.) and 10 parts by mass of a styrene acrylic resin "FSR-051" (manufactured by Fujikura Kasei Co., Ltd.) having a weight-average molecular weight (Mw) of 85500 as the grinding aid, 12 parts by mass of a master batch containing Magenta R269 in a concentration of 40% as the coloring agent, 6 parts by mass of "POWDERED TYPE #1 CARNAUBA WAX" (manufactured by Nippon Wax Co., Ltd.) as the mold release agent, and 1 part by mass of "LR-147" (manufactured by Japan Carlit Co., Ltd.) as the charge controlling agent were used and weighed so that the total amount thereof was 30 kg, and mixed in a HENSCHEL MIXER having a capacity of 150 L.

The obtained mixture was melt-kneaded in a twin-screw extruder (screw diameter 43 mm, L/D=34), and the melt-kneaded mixture was stretched and cooled to harden while setting the temperature of circulating water of rolling rolls at 10° C. This kneaded mixture after hardening was coarsely ground by a "ROTOPLEX" grinder (manufactured by Hosokawa Micron Co., Ltd., 2 mm screen).

Thereafter, grinding and classification were performed by an impinging type grinding mill "UFS-2" (manufactured by Nippon Pneumatic Mfg Co., Ltd.) and an air classifier "UFC-2" (manufactured by Nippon Pneumatic Mfg Co., Ltd.) so that the average particle size of the toner was 7.5 μm, whereby colored fine particles were obtained.

To 100 parts by mass of the obtained colored fine particles, 2.5 parts by mass of hydrophobic silica "RY50" (Nippon Aerosil Co., Ltd.) having a primary particle size of 40 nm, 0.8 parts by mass of hydrophobic silica "TG-810G" (manufactured by CABOT Corporation) having a primary particle size of 7 nm, and 1.3 parts by mass of hydrophobic silica "TG-C190" (manufactured by CABOT Corporation) having a primary particle size of 115 nm were added as the external additive, and they were mixed in a "HENSCHEL MIXER", and then sieved to obtain an electrophotographic toner.

Example 2

A toner was fabricated in the same manner as in Example 1 except that 10 parts by mass of a styrene acrylic resin "FSR-055" (manufactured by Fujikura Kasei Co., Ltd.) having a weight-average molecular weight (Mw) of 118000 was used as the styrene acrylic resin serving as a grinding aid.

Example 3

A toner was fabricated in the same manner as in Example 1 except that 10 parts by mass of a styrene acrylic resin "FB-676" (manufactured by Mitsubishi Rayon Co., Ltd.) having a weight-average molecular weight (Mw) of 112000 was used as the styrene acrylic resin serving as a grinding aid.

Example 4

A toner was fabricated in the same manner as in Example 1 except that 10 parts by mass of a styrene acrylic resin "FB-1157" (manufactured by Mitsubishi Rayon Co., Ltd.) having a weight-average molecular weight (Mw) of 110000 was used as the styrene acrylic resin serving as a grinding aid.

Example 5

A toner was fabricated in the same manner as in Example 1 except that 53 parts by mass of a binding resin was used and 8 parts by mass of a styrene acrylic resin "FSR-051" (manufactured by Fujikura Kasei Co., Ltd.) was used.

Example 6

A toner was fabricated in the same manner as in Example 1 except that 49 parts by mass of a binding resin was used and 12 parts by mass of a styrene acrylic resin "FSR-051" (manufactured by Fujikura Kasei Co., Ltd.) was used.

Example 7

A toner was fabricated in the same manner as in Example 2 except that 53 parts by mass of a binding resin was used and 8 parts by mass of a styrene acrylic resin "FSR-055" (manufactured by Fujikura Kasei Co., Ltd.) was used.

Example 8

A toner was fabricated in the same manner as in Example 2 except that 49 parts by mass of a binding resin was used and 12 parts by mass of a styrene acrylic resin "FSR-055" (manufactured by Fujikura Kasei Co., Ltd.) was used.

Example 9

A toner was fabricated in the same manner as in Example 3 except that 53 parts by mass of a binding resin was used and 8 parts by mass of a styrene acrylic resin "FB-676" (manufactured by Mitsubishi Rayon Co., Ltd.) was used.

Example 10

A toner was fabricated in the same manner as in Example 3 except that 49 parts by mass of a binding resin was used and 12 parts by mass of a styrene acrylic resin "FB-676" (manufactured by Mitsubishi Rayon Co., Ltd.) was used.

Example 11

A toner was fabricated in the same manner as in Example 4 except that 53 parts by mass of a binding resin was used and 8 parts by mass of a styrene acrylic resin "FB-1157" (manufactured by Mitsubishi Rayon Co., Ltd.) was used.

Example 12

A toner was fabricated in the same manner as in Example 4 except that 49 parts by mass of a binding resin was used and 12 parts by mass of a styrene acrylic resin "FB-676" (manufactured by Mitsubishi Rayon Co., Ltd.) was used.

Example 13

A toner was fabricated in the same manner as in Example 1 except that an amorphous polylactic resin having a weight-average molecular weight (Mw) of 120000 was used as a binding resin.

Example 14

A toner was fabricated in the same manner as in Example 1 except that an amorphous polylactic resin having a weight-average molecular weight (Mw) of 55000 was used as a binding resin.

Example 15

A toner was fabricated in the same manner as in Example 1 except that a terpene phenol resin "YS POLYSTAR G150" (manufactured by Yasuhara Chemical Co., Ltd.) was used as the terpene phenol resin serving as a grinding aid.

Example 16

A toner was fabricated in the same manner as in Example 1 except that 46 parts by mass of a binding resin was used and 25 parts by mass of a terpene phenol resin "YS POLYSTAR N125" (manufactured by Yasuhara Chemical Co., Ltd.) was used.

Example 17

A toner was fabricated in the same manner as in Example 1 except that 56 parts by mass of a binding resin was used and 15 parts by mass of a terpene phenol resin "YS POLYSTAR N125" (manufactured by Yasuhara Chemical Co., Ltd.) was used.

Example 18

A toner was fabricated in the same manner as in Example 1 except that 46 parts by mass of an amorphous polylactic resin having a weight-average molecular weight (Mw) of 55000 was used as a binding resin and 25 parts by mass of a terpene phenol resin "YS POLYSTAR G150" (manufactured by Yasuhara Chemical Co., Ltd.) was used a grinding aid.

Example 19

A toner was fabricated in the same manner as in Example 1 except that 56 parts by mass of an amorphous polylactic resin having a weight-average molecular weight (Mw) of 55000 was used as a binding resin and 15 parts by mass of a terpene phenol resin "YS POLYSTAR G150" (manufactured by Yasuhara Chemical Co., Ltd.) was used a grinding aid.

Comparative Example 1

A toner was fabricated in the same manner as in Example 1 except that 81 parts by mass of a binding resin was used and a terpene phenol resin as a grinding aid was not used.

Comparative Example 2

A toner was fabricated in the same manner as in Example 1 except that 81 parts by mass of an amorphous polylactic resin having a weight-average molecular weight (Mw) of 55000 was used as a binding resin, and a terpene phenol resin as a grinding aid was not used.

Comparative Example 3

A toner was fabricated in the same manner as in Example 1 except that 81 parts by mass of a binding resin was used, 10 parts by mass of a styrene acrylic resin "FSR-055" (manufactured by Fujikura Kasei Co., Ltd.) having a weight-average molecular weight (Mw) of 118000 was used as the styrene acrylic resin serving as a grinding aid, and a terpene phenol resin as a grinding aid was not used.

Comparative Example 4

A toner was fabricated in the same manner as in Example 1 except that 20 parts by mass of a terpene phenol resin "YS POLYSTAR U115" (manufactured by Yasuhara Chemical Co., Ltd.) was used as a grinding aid.

Comparative Example 5

A toner was fabricated in the same manner as in Example 1 except that 20 parts by mass of a terpene hydrogenated resin "CLEARON P135" (manufactured by Yasuhara Chemical Co., Ltd.) was used as a grinding aid.

Comparative Example 6

A toner was fabricated in the same manner as in Example 1 except that 20 parts by mass of a rosin ester resin "PENCEL D135" (manufactured by Arakawa Chemical Industries, Ltd.) was used as a grinding aid.

Comparative Example 7

A toner was fabricated in the same manner as in Example 1 except that 41 parts by mass of a binding resin was used, and 30 parts by mass of a terpene phenol resin "YS POLYSTAR N125" (manufactured by Yasuhara Chemical Co., Ltd.) was used as a grinding aid.

Comparative Example 8

A toner was fabricated in the same manner as in Example 1 except that 31 parts by mass of a binding resin was used, and 40 parts by mass of a terpene phenol resin "YS POLYSTAR N125" (manufactured by Yasuhara Chemical Co., Ltd.) was used as a grinding aid.

Comparative Example 9

A toner was fabricated in the same manner as in Example 1 except that 61 parts by mass of a binding resin was used, and 10 parts by mass of a terpene phenol resin"YS POLYSTAR N125" (manufactured by Yasuhara Chemical Co., Ltd.) was used as a grinding aid.

Comparative Example 10

A toner was fabricated in the same manner as in Example 1 except that 61 parts by mass of an amorphous polylactic resin having a weight-average molecular weight (Mw) of 30000 was used as a binding resin, and a styrene acrylic resin as a grinding aid was not used.

Comparative Example 11

A toner was fabricated in the same manner as in Example 1 except that 61 parts by mass of an amorphous polylactic resin having a weight-average molecular weight (Mw) of 50000 was used as a binding resin, and a styrene acrylic resin as a grinding aid was not used.

Comparative Example 12

A toner was fabricated in the same manner as in Example 1 except that 51 parts by mass of an amorphous polylactic resin having a weight-average molecular weight (Mw) of 50000 was used as a binding resin.

Comparative Example 13

A toner was fabricated in the same manner as in Example 1 except that 61 parts by mass of an amorphous polylactic resin having a weight-average molecular weight (Mw) of 55000 was used as a binding resin, and a styrene acrylic resin as a grinding aid was not used.

Comparative Example 14

A toner was fabricated in the same manner as in Example 1 except that 61 parts by mass of a binding resin was used, and a styrene acrylic resin as a grinding aid was not used.

Comparative Example 15

A toner was fabricated in the same manner as in Example 1 except that 61 parts by mass of an amorphous polylactic resin having a weight-average molecular weight (Mw) of 120000 was used as a binding resin, and a styrene acrylic resin as a grinding aid was not used.

Comparative Example 16

A toner was fabricated in the same manner as in Example 1 except that 61 parts by mass of an amorphous polylactic resin having a weight-average molecular weight (Mw) of 130000 was used as a binding resin, and a styrene acrylic resin as a grinding aid was not used.

Comparative Example 17

A toner was fabricated in the same manner as in Example 1 except that 51 parts by mass of a crystalline polylactic resin having a weight-average molecular weight (Mw) of 130000 was used as a binding resin.

Comparative Example 18

A toner was fabricated in the same manner as in Example 1 except that 61 parts by mass of a crystalline polylactic resin having a weight-average molecular weight (MW) of 150000 was used as a binding resin.

Comparative Example 19

A toner was fabricated in the same manner as in Comparative Example 3 except that 61 parts by mass of an amorphous polylactic resin having a weight-average molecular weight (Mw) of 55000 was used as a binding resin, 20 parts by mass of a terpene phenol resin "YS POLYSTAR G150" (manufactured by Yasuhara Chemical Co., Ltd.) was used as a grinding aid, and a styrene acrylic resin as a grinding aid was not used.

Comparative Example 20

A toner was fabricated in the same manner as in Comparative Example 3 except that 61 parts by mass of a binding resin was used, 20 parts by mass of a terpene phenol resin "YS POLYSTAR G150" (manufactured by Yasuhara Chemical Co., Ltd.) was used as a grinding aid, and a styrene acrylic resin as a grinding aid was not used.

Comparative Example 21

A toner was fabricated in the same manner as in Comparative Example 3 except that 61 parts by mass of a crystalline polylactic resin having a weight-average molecular weight (Mw) of 120000 was used as a binding resin, 20 parts by mass of a terpene phenol resin "YS POLYSTAR G150" (manufactured by Yasuhara Chemical Co., Ltd.) was used as a grinding aid, and a styrene acrylic resin as a grinding aid was not used.

Comparative Example 22

A toner was fabricated in the same manner as in Example 1 except that 41 parts by mass of a binding resin was used, and 20 parts by mass of a styrene acrylic resin "FSR-051" (manufactured by Fujikura Kasei Co., Ltd.) was used.

Comparative Example 23

A toner was fabricated in the same manner as in Example 1 except that 31 parts by mass of a binding resin was used, and 30 parts by mass of a styrene acrylic resin "FSR-051" (manufactured by Fujikura Kasei Co., Ltd.) was used.

Comparative Example 24

A toner was fabricated in the same manner as in Example 1 except that 56 parts by mass of a binding resin was used, and 5 parts by mass of a styrene acrylic resin "FSR-051" (manufactured by Fujikura Kasei Co., Ltd.) was used.

Comparative Example 25

A toner was fabricated in the same manner as in Example 1 except that 41 parts by mass of a binding resin was used, 20 parts by mass of "YS POLYSTAR G150" (manufactured by Yasuhara Chemical Co., Ltd.) was used as the terpene phenol resin serving as a grinding aid, and 20 parts by mass of a styrene acrylic resin "FSR-055" (manufactured by Fujikura Kasei Co., Ltd.) having a weight-average molecular weight (Mw) of 118000 was used as the styrene acrylic resin serving as a grinding aid.

Comparative Example 26

A toner was fabricated in the same manner as in Example 1 except that 31 parts by mass of a binding resin was used, 20 parts by mass of "YS POLYSTAR G150" (manufactured by Yasuhara Chemical Co., Ltd.) was used as the terpene phenol resin serving as a grinding aid, and 30 parts by mass of a styrene acrylic resin "FSR-055" (manufactured by Fujikura Kasei Co., Ltd.) having a weight-average molecular weight (Mw) of 118000 was used as the styrene acrylic resin serving as a grinding aid.

Comparative Example 27

A toner was fabricated in the same manner as in Example 1 except that 10 parts by mass of a styrene acrylic resin "FSR-020" (manufactured by Fujikura Kasei Co., Ltd.) having a weight-average molecular weight (Mw) of 34500 was used as the styrene acrylic resin serving as a grinding aid.

Comparative Example 28

A toner was fabricated in the same manner as in Example 1 except that 10 parts by mass of a styrene acrylic resin "FSR-044" (manufactured by Fujikura Kasei Co., Ltd.) having a weight-average molecular weight (Mw) of 13200 was used as the styrene acrylic resin serving as a grinding aid.

Comparative Example 29

A toner was fabricated in the same manner as in Example 1 except that 10 parts by mass of a styrene acrylic resin "FSR-053" (manufactured by Fujikura Kasei Co., Ltd.) having a weight-average molecular weight (Mw) of 400000 was used as the styrene acrylic resin serving as a grinding aid.

Comparative Example 30

A toner was fabricated in the same manner as in Example 1 except that 10 parts by mass of a styrene acrylic resin "TIZ-470" (manufactured by Fujikura Kasei Co., Ltd.) having a weight-average molecular weight (Mw) of 180000 was used as the styrene acrylic resin serving as a grinding aid.

Comparative Example 31

A toner was fabricated in the same manner as in Example 1 except that 10 parts by mass of a styrene acrylic resin "FB-1760" (manufactured by Mitsubishi Rayon Co., Ltd.) having a weight-average molecular weight (Mw) of 67000 was used as the styrene acrylic resin serving as a grinding aid.

Comparative Example 32

A toner was fabricated in the same manner as in Example 1 except that 10 parts by mass of a styrene acrylic resin "FB-1765" (manufactured by Mitsubishi Rayon Co., Ltd.) having a weight-average molecular weight (Mw) of 260000 was used as the styrene acrylic resin serving as a grinding aid.

Comparative Example 33

A toner was fabricated in the same manner as in Example 1 except that 53 parts by mass of a binding resin was used, and 8 parts by mass of a styrene acrylic resin "FSR-020" (manufactured by Fujikura Kasei Co., Ltd.) having weight-average molecular weight (Mw) of 34500 was used as the styrene acrylic resin serving as a grinding aid.

Comparative Example 34

A toner was fabricated in the same manner as in Example 1 except that 49 parts by mass of a binding resin was used, and 12 parts by mass of a styrene acrylic resin "FSR-020" (manufactured by Fujikura Kasei Co., Ltd.) having weight-average molecular weight (Mw) of 34500 was used as the styrene acrylic resin serving as a grinding aid.

Comparative Example 35

A toner was fabricated in the same manner as in Example 1 except that 51 parts by mass of an amorphous polylactic resin having a weight-average molecular weight (Mw) of 120000 was used as a binding resin, and 10 parts by mass of a styrene acrylic resin "FSR-053" (manufactured by Fujikura Kasei Co., Ltd.) having a weight-average molecular weight (Mw) of 400000 was used as the styrene acrylic resin serving as a grinding aid.

Comparative Example 36

A toner was fabricated in the same manner as in Example 1 except that 51 parts by mass of an amorphous polylactic resin having a weight-average molecular weight (Mw) of 55000 was used as a binding resin, and 10 parts by mass of a styrene acrylic resin "FSR-053" (manufactured by Fujikura Kasei Co., Ltd.) having a weight-average molecular weight (Mw) of 400000 was used.

The fabricated toners were subjected to measurement and evaluation according to the following methods.

1. Grindability

The grindability was evaluated according to the following criteria, based on the feed amounts in performing grinding and classification by the impinging type grinding mill "UFS-2" (manufactured by Nippon Pneumatic Mfg Co., Ltd.) and the air classifier "UFC-2" (manufactured by Nippon Pneumatic Mfg Co., Ltd.) described above.

◎: 8 kg/equal to or more than hr

○: 5 kg/more than hr, 8 kg/less than hr

Δ: 3 kg/more than hr, 5 kg/less than hr x: 3 kg/equal to or less than hr

2. Fixing Property

The obtained toner was set on a printer "GE6000" (manufactured by CASIO Computer Co., Ltd.), the fixing temperature was varied from 120° C. to 190° C. at an interval of 5° C., and ten 100% solid images were printed continuously at each temperature. Here, the absence or presence of fixing offset in printing at each temperature was confirmed, and the width of the temperature range containing no offset was evaluated according to the following criteria.

○: 50° C. or higher

Δ: over 30° C., lower than 50° C.

x: 30° C. or lower

3. Durability

The obtained toner was set on a printer "GE6000" (manufactured by CASIO Computer Co., Ltd.), and a 1.7% print image was intermittently printed on 40000 pieces of paper such that it is printed on five pieces of paper in each printing. During the procedure, sample images were printed every 5000 pieces of paper, and durability was evaluated according to the following criteria, based on the amount of stripes generated on this image.

○: no stripe was observed (no problem)

Δ: several strips were observed x: a lot of stripes were observed

4. Total Result

The total result was comprehensively evaluated according to the above-described evaluations 1 to 3.

The results are summarized in FIG. 3 (*a*) to FIG. 3 (*e*) and FIG. 4 (*a*) to FIG. 4 (*j*).

FIG. 3 (*a*) to FIG. 3 (*e*) are diagrams constituting an outsized table divided into subsections showing examples of the present invention and FIG. 3 (*f*) is an additional drawing that indicates the manner in which the subsections FIG. 3 (*a*) to FIG. 3 (*e*) fit together as a whole.

FIG. 4 (*a*) to FIG. 4 (*j*) are diagrams constituting an outsized table divided into subsections showing comparative examples of the present invention and FIG. 4 (*k*) is an additional drawing that indicates the manner in which the subsections FIG. 4 (*a*) to FIG. 4 (*j*) fit together as a whole.

As shown in FIG. 3 (*a*) to FIG. 3 (*e*). Examples 1 to 19 attained excellent performances in all of grindability, fixing property and durability. Especially, Examples 1 to 4, 6, 8, 10, 12 and 13 could attain more excellent grindability as compared with Examples 5, 7, 9, 11, 14 to 19.

As apparent from comparison between Examples 1 to 19 and Comparative Examples 10 to 12 and 16 to 18 shown in FIG. 4 (*a*) to FIG. 4 (*j*), the molecular weight (Mw) of polylactic resin is preferably in the range of 55000 to 120000.

Note that, at a molecular weight (Mw) of 30000, the polylactic resin was liquid and could not be formed into a toner. At a molecular weight (Mw) of 50000, the grindability of the polylactic resin was ensured but the fixing property and durability thereof were poor because of low molecular weight.

In contrast, when the polylactic resin had a molecular weight (Mw) of 130000 or more, grindability thereof was poor. At a molecular weight (Mw) 150000, the resin could not be formed into a toner because of too high hardness.

As apparent from comparison between Examples 1 to 19 and Comparative Examples 1 to 6, 13 to 16 and 18 to 21, use of a grinding aid composed of a prescribed combination of a terpene phenol resin and a styrene acrylic resin is indispensable for attaining sufficient grindability.

Though Comparative Example 4 used YS Polystar U115 as a terpene phenol resin, the fixing property and durability were problematic due to low softening temperature. Therefore, even if a terpene phenol resin is used, those having prescribed softening temperatures are desirable. The range of the softening temperature of the terpene phenol resin is preferably 125° C. to 150° C.

In Comparative Examples 5 and 6, durability deteriorated though a terpene hydrogenated resin and a rosin resin as the terpene resin were used.

The fixing property deteriorated in any of Comparative Examples 7, 8 and 9 though YS Polystar N125 which was the same as in Examples 1 to 19 was added in an amount of 30, 40 and 10%, respectively, in Comparative Examples 7, 8 and 9. This is because the molecular weight of the terpene phenol resin is low and, when it is added in large amount, the fixing property as a toner becomes worse. When the addition amount is small, grindability is not satisfied.

Therefore, it is advantageous that the amount of the terpene phenol resin is 15 to 25%, preferably 20%, according to Examples 1 to 19.

In contrast, Comparative Examples 22 to 26 were examples in which the styrene acrylic resin was added in an amount of 5 to 30%. When the addition amount thereof was large, the fixing property was poor. In addition, the degree of derivation of the toner from biomass, which was the original object, was lowered. When the addition amount was small conversely, grindability could not be kept.

Therefore, it is advantageous that the amount of the styrene acrylic resin is 8 to 12%, preferably 10%, according to Examples 1 to 19.

In Comparative Examples 27, 33 and 34, the styrene acrylic resin had a molecular weight (Mw) of 34500 and the toner formation was performed in the same manner as in Example 1.4 Here, grindability was excellent without problem but defects occurred in the fixing property and durability. This is because the molecular weight of the styrene acrylic resin was low and grindability was ensured but the toner strength correlated with durability and fixing property could not be kept, resulting in occurrence of problems.

Similarly, in Comparative Examples 28 and 31, the styrene acrylic resin had a molecular weight of 13200 and 67000, and grindability was not problematic. However, the toner strength correlated with durability could not be kept, leading to occurrence of problems.

In contrast, in Comparative Examples 29, 30 and 32, the styrene acrylic resin had a molecular weight (Mw) of 400000, 180000 and 260000, and the toner formation was performed in the same manner as in Example 1. However, grindability could not be kept and toner formation was difficult. This is because the molecular weight of the styrene acrylic resin was high, which deteriorated the grindability of the whole toner.

In Comparative Examples 35 and 36, the styrene acrylic resin having a molecular weight (Mw) of 400000 was added in an amount of 10% and the PLA resin had a molecular weight (Mw) of 120000 and 55000. However, grindability could not be kept.

As apparent from the results of Examples 1 to 19 and Comparative Examples 1 to 36 described above, a combination of amorphous polylactic acid having a weight-average molecular weight (Mw) of 55000 to 120000, a terpene phenol resin, and a styrene acrylic resin having a weight-average molecular weight (Mw) of 85500 to 118000 produced the best result.

While the present invention has been described with reference to the preferred embodiments, it is intended that the invention be not limited by any of the details of the description therein but includes all the embodiments which fall within the scope of the appended claims.

What is claimed is:

1. An electrophotographic toner comprising:

(a) an amorphous polylactic acid having a weight-average molecular weight (Mw) of 55000 to 120000 and (b) grinding aids comprising (i) a terpene phenol resin contained in an amount of 15 to 25% by mass with respect to a toner mass and having a softening temperature of 125° C. to 150° C., and (ii) a styrene acrylic resin contained in an amount of 8 to 12% by mass with respect to a toner mass and having a weight-average molecular weight (Mw) of 85500 to 118000, the toner mass being defined as a total mass of toner raw materials including internal additives, and excluding external additives, wherein the grinding aids each have a weight-average degree of polymerization of 500 to 5000.

2. The electrophotographic toner according to claim 1, wherein the amorphous polylactic acid is contained in an amount of 20 to 80% by mass with respect to the toner mass.

3. The electrophotographic toner according to claim 1, wherein the terpene phenol resin and the styrene acrylic resin are contained in a total amount of 25 to 35% by mass with respect to the toner mass.

4. The electrophotographic toner according to claim 1, wherein the terpene phenol resin and the styrene acrylic resin are contained in a total amount of 28 to 32% by mass with respect to the toner mass.

5. A method of producing an electrophotographic toner comprising:

a step of melt-kneading a mixture containing (a) an amorphous polylactic acid having a weight-average molecular weight (Mw) of 55000 to 120000 and (b) grinding aids comprising (i) a terpene phenol resin contained in an amount of 15 to 25% by mass with respect to a toner mass and having a softening temperature of 125° C. to 150° C., and (ii) a styrene acrylic resin contained in an amount of 8 to 12% by mass with respect to a toner mass and having a weight-average molecular weight (Mw) of 85500 to 118000, to obtain a kneaded mixture, the toner mass being defined as a total mass of toner raw materials including internal additives and excluding external additives; and a step of grinding the kneaded mixture after hardening, wherein the grinding aids each have a weight-average degree of polymerization of 500 to 5000.

6. The method according to claim 5, wherein the kneaded mixture is obtained by kneading with a twin screw kneader.

7. The method according to claim 5, wherein the kneaded mixture is obtained by kneading with an open roll kneading machine.

8. The method according to claim 5, wherein the amorphous polylactic acid is contained in an amount of 20 to 80% by mass with respect to the toner mass.

9. The method according to claim 5, wherein the terpene phenol resin and the styrene acrylic resin are contained in a total amount of 25 to 35% by mass with respect to the toner mass.

10. The method according to claim 5, wherein the terpene phenol resin and the styrene acrylic resin are contained in a total amount of 28 to 32% by mass with respect to the toner mass.

* * * * *